United States Patent [19]

Valentini

[11] Patent Number: 4,859,249

[45] Date of Patent: Aug. 22, 1989

[54] PROCESS FOR CLEANING ENCLOSED VESSELS

[75] Inventor: Jose E. Valentini, Hendersonville, N.C.

[73] Assignee: E. I. Du Pont De Nemours and Company, Wilmington, Del.

[21] Appl. No.: 167,867

[22] Filed: Mar. 14, 1988

[51] Int. Cl.[4] ..... B08B 3/02

[52] U.S. Cl. ..... 134/22.18; 15/320; 15/321; 15/322; 122/292; 122/290; 134/22.12; 134/32; 134/24; 134/167 R; 134/168 R; 134/169 R

[58] Field of Search ..... 134/22.12, 22.18, 32, 134/24, 166 C, 167 R, 169 R, 168 R; 122/292, 290; 15/320, 321, 322

[56] References Cited

U.S. PATENT DOCUMENTS 3,741,808 6/1973 Stalker ..... 134/58 R
3,791,583 2/1974 Nunlist et al. ..... 239/227
3,985,572 10/1976 Petermann et al. ..... 134/34
4,620,881 11/1986 Booji ..... 134/21

*Primary Examiner*—Asok Pal

[57] ABSTRACT

Cleaning process for removing material coated on the inner surface of an enclosed vessel. e.g., photographic emulsion, photopolymer, subbing layer, chemicals, etc., comprising A. forming a substantially continuous high pressure stream of cleaning liquid, e.g., water, solvent, B. supplying the stream of liquid at a pressure, 4000 to 8000 psi to at least one fixed point in the vessel, C. dividing the stream into at least two opposed paths, and D. directing the liquid onto said surfaces in a 360° solid angle using the fixed point as the angle vertex.

The process is particularly useful in cleaning photographic emulsions but is also useful in removing other chemical materials and chemicals from an enclosed vessel.

14 Claims, 5 Drawing Sheets

Fig. 5
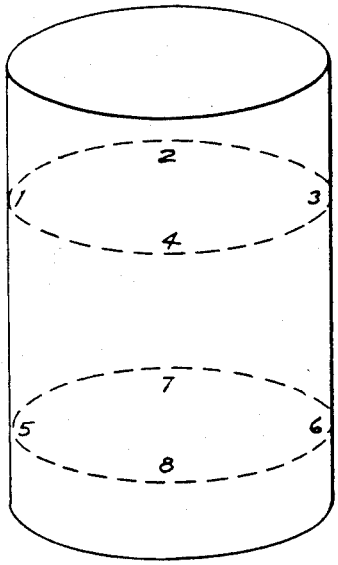
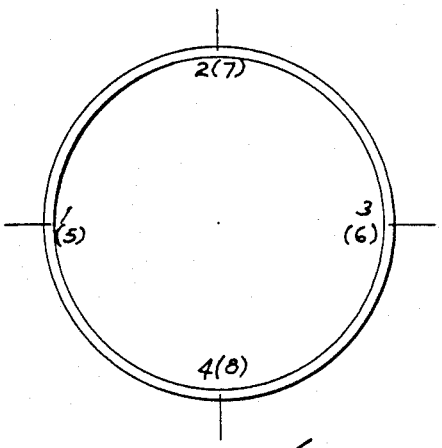
Fig. 6

PROCESS FOR CLEANING ENCLOSED VESSELS

TECHNICAL FIELD

This invention relates to a process for cleaning an enclosed vessel. More particularly, this invention relates to a process utilizing a high pressure stream of liquid to clean an enclosed vessel.

BACKGROUND OF THE INVENTION

Cleaning of enclosed vessels is an important task in the chemical industry. In particular reference to the photographic industry, large vessels or kettles are utilized to prepare silver halide emulsions, and these vessels must be cleaned regularly because the inner surfaces of the vessels and baffles and agitators located in the vessels become contaminated and fouled, e.g., as the vessels empty at elevated temperature. If the vessels were not thoroughly cleaned, subsequent batches of silver halide emulsion prepared therein would be contaminated and useless for photographic purposes.

Cleaning of the vessel interiors has heretofore been accomplished by manually scraping the interior walls, baffles and agitator blades. Manual methods are time consuming and expensive in that they require lock-out of the whole system during the cleaning operation. Furthermore, manual methods have been found to be ineffective to thoroughly clean all the interior areas of a vessel due to inherent deficiencies of a manual operation and the difficulties encountered in reaching some areas because of the location of baffles, agitators, etc., in the vessels. There is the additional problem of subjecting the surfaces to be cleaned to scratches because of the use of scrapers.

Hand lances using high pressure nozzles have been used in the past but they create hazards for the operating personnel because of the high pressure involved.

It has been found that these and other difficulties can be overcome by using the method of the invention for cleaning enclosed vessels, for example, photographic vessels or kettles.

SUMMARY OF THE INVENTION

In accordance with this invention there is provided a cleaning process for removing material coated on the inner surfaces of an enclosed vessel comprising:

A. forming a substantially continuous high pressure stream of cleaning liquid,

B. supplying said stream of cleaning liquid at a pressure in the range of 4000 to 8000 psi to at least one fixed point in the vessel.

C. dividing the high pressure stream into at least two opposed paths, and

D. directing the cleaning liquid onto said surfaces in a 360° solid angle using the fixed point as the vertex of the solid angle.

BRIEF DESCRIPTION OF THE DRAWINGS

In the accompanying drawings forming a material part of this disclosure:

FIG. 5 is a perspective transparent view of an enclosed vessel showing positions of the nozzle head during cleaning.

FIG. 6 is a schematic plan view of the vessel shown in FIG. 5 showing positions of the nozzle head during cleaning.

DETAILED DESCRIPTION OF THE INVENTION

Figure 1:
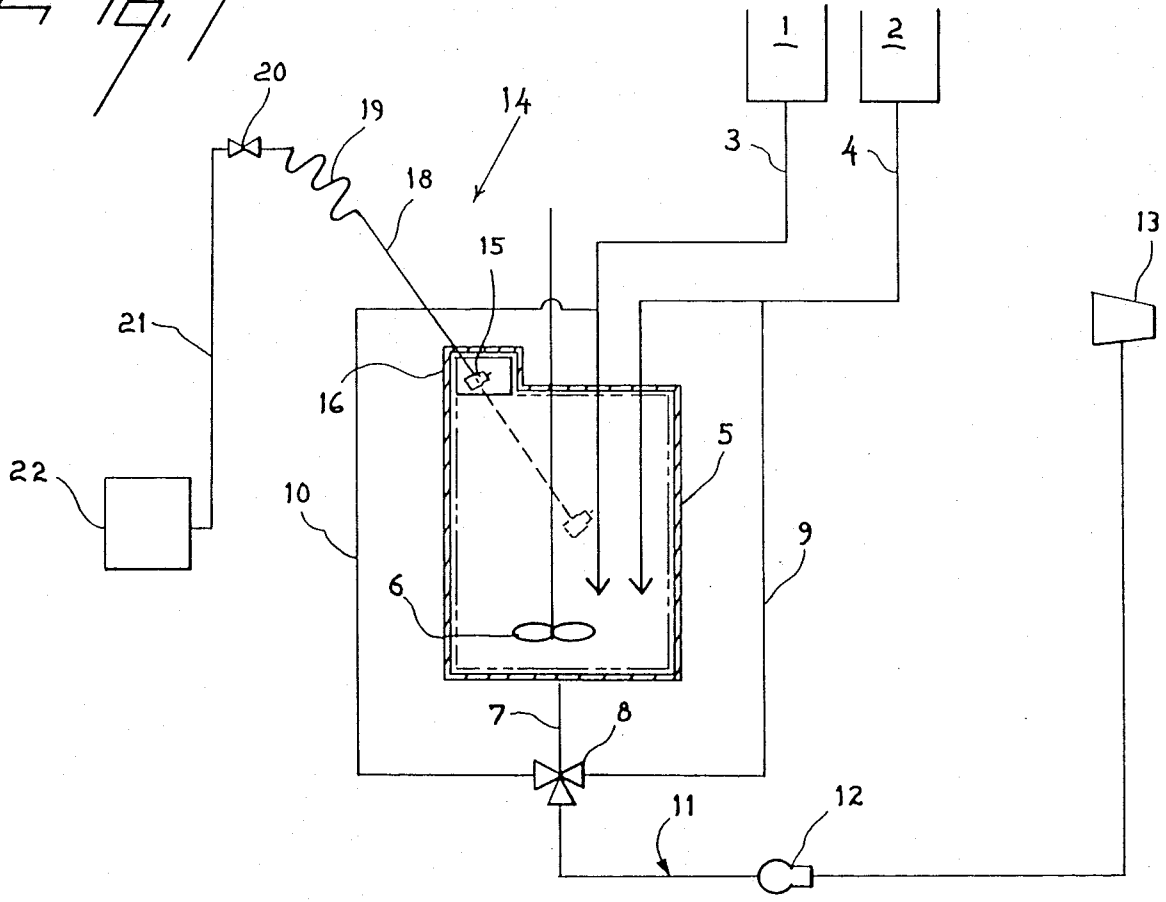
FIG. 1 is a schematic diagram of an apparatus for preparing a silver halide emulsion, including an enclosed vessel in cross-section.

The process of cleaning of this invention will be described below in conjunction with the preparation of a silver halide emulsion. The process of the invention, however, is not so limited as other known chemical materials and chemicals can be removed from vessels thereby.

In the preparation of silver halide emulsions, silver nitrate and halide solutions are fed from storage tanks 1 and 2 through lines 3 and 4, respectively, equipped with valves and metering pumps (not shown) to an enclosed precipitation vessel 5 which is jacketed so as to permit the circulation of heating or cooling liquid, e.g., water, etc., in direct contact with the outer wall of the vessel. The precipitation vessel 5 is equipped with an agitator or paddle 6 and an initial charge of gelatin solution (not shown). At the bottom of precipitation vessel 5 is located a discharge line 7 equipped with a three-way valve 8 which permits recirculation of the precipitated grains back to the vessel through lines 9 and 10, or discharge of the grains through line 11 via pump 12 and filters, heat exchangers. deaerators and additional pumps (not shown) to coating head 13. The recirculation lines 9 and 10 may be equipped with mixers, rotameters, valves, heat exchangers, etc. (not shown).

Figure 3:
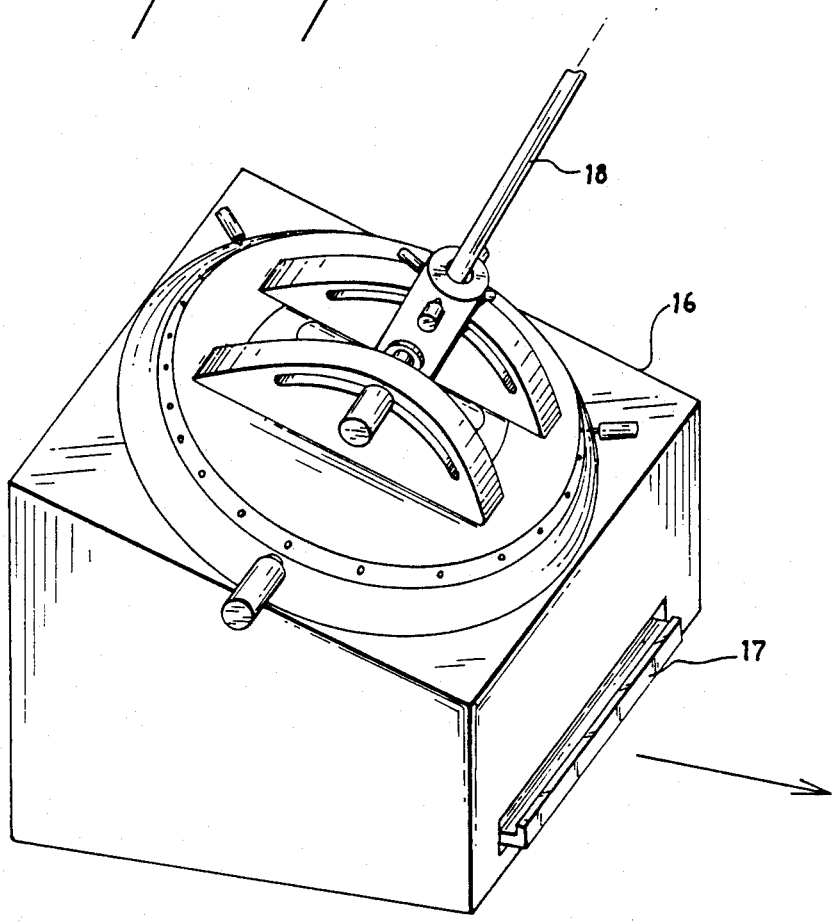
FIG. 3 is a prospective view of a housing design that protects the nozzle head when not in use.

During the preparation of the silver halide emulsion the cleaning apparatus 14 is held outside the precipitation vessel 5 with nozzle head 15 retracted into housing 16 as shown in FIGS. 1 and 3. As shown in FIG. 3, metal panel 17 protects the nozzle head 15 from contamination during the emulsion preparation process. The nozzle head 15 is attached through a retractable lance 18, flexible pipe 19, valve 20 and rigid pipe 21 to high pressure pump 22. The nozzle head and high pressure pump are manufactured by NLB Corporation, Wixom, MI.

Figure 2:
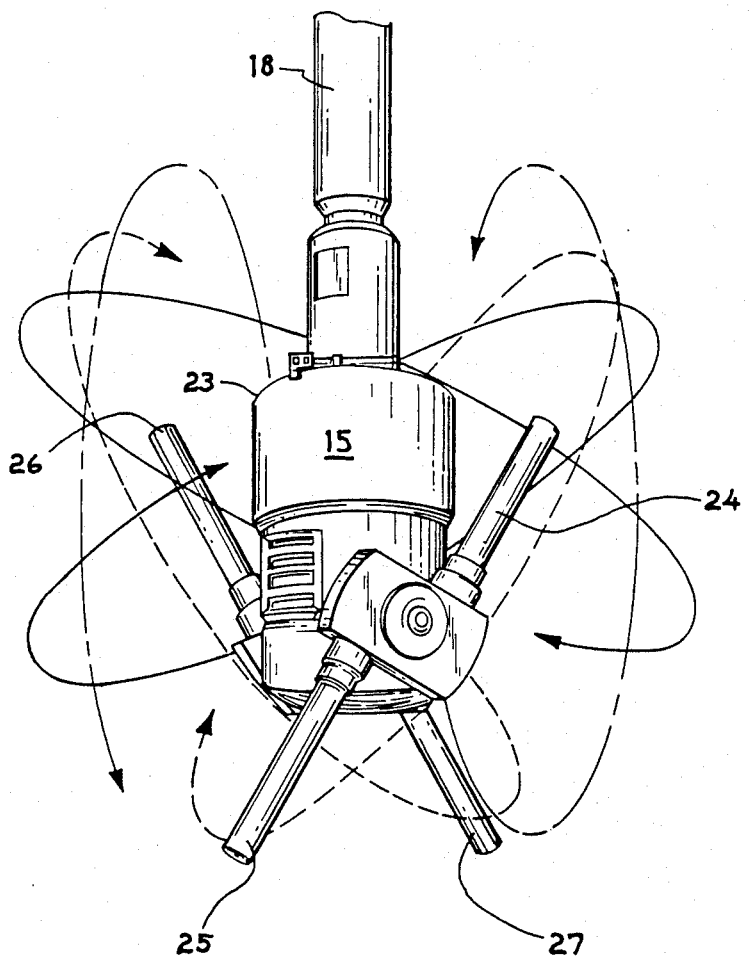
FIG. 2 is a detailed view of a nozzle head which allows for the direction of cleaning liquid in a 360° solid angle.
Figure 4:
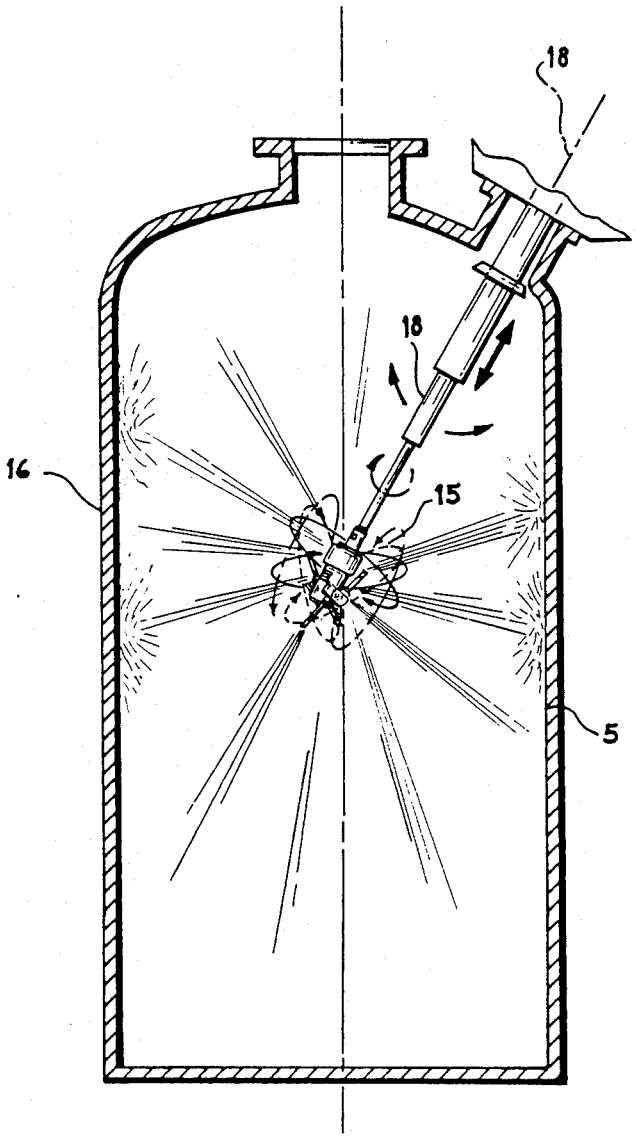
FIG. 4 is a view in cross-section of an enclosed vessel showing a lance assembly and nozzle head in use in the vessel.

During the cleaning operation, the nozzle head 15 is positioned, e.g., by means of the retractable lance 18, at a fixed point within the vessel and locked in place, e.g., by tightening knobs which hold lance 18 (FIG. 3). The nozzle head may be positioned about 5 inches (12.7 cm) from the vessel wall. The positioning is such to ensure that the liquid jet will impact tangentially to the vessel wall. The high pressure pump 22 is turned on supplying the nozzle head 15 with cleaning liquid at a pressure in the range of about 4000 to 8000 psi, the stream of cleaning liquid is divided into at least two opposed paths, e.g., by two sets of diametrically opposed nozzles described more fully below, and the liquid is directed at the surfaces of the vessel to be cleaned in a 360° solid angle using the fixed point as the vertex of the angle as shown in FIGS. 2 and 4. After that portion of the precipitation vessel 5 is cleaned, e.g., a cleaning cycle of about 1 to 3 minutes, the pump 22 is stopped, and the nozzle head 15 is moved to a different fixed point in the vessel, e.g., as shown in FIGS. 5 and 6, and the cleaning operation is repeated. Several fixed points, e.g., 4 to 8 in number, are generally needed to clean an enclosed vessel, e.g., of about 800 gallons (3028 liters) capacity, the number of fixed points, however, being dependent on the size and configuration of the vessel.

As shown in FIG. 2, the nozzle head 15 comprises a nozzle head housing 23 to which is rotatably attached two sets of diametrically opposed nozzles 24, 25 and 26, 27, respectively. The nozzle head 15 is capable of rotating about its axis and the nozzles are freely rotated by the high pressure of the cleaning liquid. Generally the nozzle sets are the same in size and configuration. The nozzle sets may differ, however, depending on their purpose and the configuration of the enclosed vessel. Cleaning liquid flow in the range of about 23–30 gallons(about 87–114 liters)/minute, preferably about 24–27 gallons (about 91–102 liters)/minute, and an operating pressure of 4000–8000 psi, more preferably 6000 psi, have been found to be useful. Different liquid flow rates, however, may be useful. The length of time needed for cleaning each fixed point is determined by the material coating or impurities on the inner surfaces of vessel 5 that need cleaning, the geometry of the vessel including piping, baffles, agitators, etc., that may be present, and the frequency of cleaning. It may be desirable to heat the enclosed vessel in which event a temperature range of about 40° to 60° C. is useful.

In the preparation of a photographic silver halide emulsion as described above, amounts of the emulsion adhere to the inner surfaces of the enclosed vessel. If allowed to remain in the vessel the next silver halide emulsion prepared therein will become contaminated. It has been found that by using the defined process with water as the cleaning liquid the enclosed vessel is satisfactorily cleaned so that the next photographic emulsion prepared in the vessel does not become contaminated. By the term "photographic silver halide emulsion" means X-ray, graphic arts, etc., photographic emulsions. The defined process is also useful in cleaning the inner surfaces of enclosed vessels of other chemical materials and contaminants than photographic emulsions. Example of other chemical materials include: subcoatings, antihalation layers, antistatic layers, etc., for photographic films; photopolymer compositions, diazo compositions, chemicals, e.g., etc. It is very desirable for ecological as well as economic reasons that the cleaning liquid be water. With most of the photographic related coatings described above, water is an excellent cleaning liquid. The particular cleaning liquid that is useful with other chemical materials or chemicals can be determined readily by simple trial. Aqueous solutions are preferred. If solvents are a problem for ecological or safety reasons then, of course, their use must be limited.

I claim:

1. A cleaning process for removing material coated on the inner surfaces of an enclosed vessel comprising A. forming a substantially continuous high pressure stream of cleaning liquid, B. supplying said stream of cleaning liquid at a pressure in the range of 4000 to 8000 psi to a nozzle head which continuously rotates and is positioned at at least one fixed point in the vessel, the nozzle head, which continuously rotates, comprising a nozzle head housing having rotatably attached thereto two sets of diametrically opposed nozzles, C. dividing the high pressure stream inside said nozzle head into at least two opposed paths, and D. directing the cleaning liquid emitting from the two sets of continuously rotating diametrically opposed nozzles onto said surfaces in a 360° solid angle using the fixed point as the vertex of the solid angle.

2. A cleaning process according to claim 1 wherein the diametrically opposed nozzles are freely rotated by the high pressure of the cleaning liquid emitted therefrom.

3. A cleaning process according to claim 1 wherein the supply of cleaning liquid is stopped, the nozzle head is moved to another fixed point in the vessel, and steps B, C and D are repeated.

4. A cleaning process according to claim 3 wherein the steps are repeated at least one time.

5. A cleaning process according to claim 1 wherein the cleaning liquid is water.

6. A cleaning process according to claim 1 wherein the material coated on the inner surfaces of the enclosed vessel is photographic silver halide emulsion and the cleaning liquid is an aqueous solution.

7. A cleaning process according to claim 1 wherein the material coated on the inner surfaces of the enclosed vessel is a photopolymerizable compositions and the cleaning liquid is a solvent therefor.

8. A cleaning process according to claim 6 wherein the aqueous solution is water.

9. A cleaning process according to claim 7 wherein the solvent is an aqueous solution.

10. A cleaning process according to claim 1 wherein the nozzle head is positioned in the enclosed vessel by means of a retractable lance.

11. A cleaning process according to claim 1 wherein the cleaning liquid is supplied in the range of 23 to 30 gallons/minute.

12. A cleaning process according to claim 1 wherein the surfaces of the enclosed vessel are heated to 40° to 60° C.

13. A cleaning process according to claim 1 wherein the high pressure stream is divided into 2 to 4 opposed paths.

14. A cleaning process according to claim 13 wherein the opposed paths are diametrically opposed.

* * * * *